US008167112B2

(12) United States Patent
Meyerhans

(10) Patent No.: US 8,167,112 B2
(45) Date of Patent: May 1, 2012

(54) METHOD AND ARRANGEMENT TO TURN PRINT PRODUCTS CONVEYED IN A FLOW ALONG A CONVEYING PATH

(75) Inventor: Rolf Meyerhans, Reiden (CH)

(73) Assignee: Mueller Martini Holding AG, Hergiswil (CH)

( * ) Notice: Subject to any disclaimer, the term of this patent is extended or adjusted under 35 U.S.C. 154(b) by 194 days.

(21) Appl. No.: 12/766,577

(22) Filed: Apr. 23, 2010

(65) Prior Publication Data

US 2010/0270121 A1 Oct. 28, 2010

(30) Foreign Application Priority Data

Apr. 23, 2009 (EP) ..... 09405071

(51) Int. Cl.
*B65G 47/24* (2006.01)

(52) U.S. Cl. ..... 198/407; 198/406; 271/186; 271/204

(58) Field of Classification Search ..... 198/377.03, 198/402, 403, 404, 406, 407, 408, 470.1, 198/475.1; 271/202, 204, 186, 291
See application file for complete search history.

(56) References Cited

U.S. PATENT DOCUMENTS 4,895,360 A * 1/1990 Reist ..... 271/204
4,896,874 A * 1/1990 Muller ..... 271/186
5,295,679 A * 3/1994 Reist ..... 271/186
6,182,960 B1 * 2/2001 Keller et al. ..... 198/470.1
6,196,538 B1 * 3/2001 Stauber et al. ..... 198/470.1

FOREIGN PATENT DOCUMENTS

| | | |
|---|---|---|
| EP | 0 242 702 A | 10/1987 |
| EP | 0 854 105 A | 7/1998 |
| EP | 1 227 052 A1 | 1/2002 |
| EP | 1 547 950 A | 6/2005 |
| GB | 2 334 711 A | 9/1999 |

OTHER PUBLICATIONS

European Search Report Issued in Priority Application No. EP 09405071.3.

* cited by examiner

*Primary Examiner* — James R Bidwell
(74) *Attorney, Agent, or Firm* — Venable LLP; Robert Kinberg; Leigh D. Thelen

(57) ABSTRACT

An arrangement to turn print products transported in a conveyed flow along a conveying path in a conveying direction that includes a first conveyor having a traction device guided over a reversing wheel. First clamps are attached to the traction device to clamp the respective print products. A second conveyor is arranged downstream the first conveyor includes second clamps arranged to receive the print products from the first conveyor. A curved turning section connects the first conveyor with the second conveyor along which the print products are turned upside down. The transfer device assists to transfer the print products from the first conveyor to the second conveyor and to turn the print products in the turning section prior to being clamped by the second clamps. The transfer device includes transfer tongs to turn the respective print products around an axis transverse to the conveying direction.

19 Claims, 7 Drawing Sheets

METHOD AND ARRANGEMENT TO TURN PRINT PRODUCTS CONVEYED IN A FLOW ALONG A CONVEYING PATH

CROSS-REFERENCE TO RELATED APPLICATION

This application claims the priority of European Patent Application No. 09405071.3, filed on Apr. 23, 2009, the subject matter of which is incorporated herein by reference.

BACKGROUND

The invention relates to a method to turn over print products which are transported in a conveyed flow along a conveying path while clamped in along one edge by the clamps of a circulating first conveyor in order to suspend the print products. Following the movement through a turning section, the print products are gripped along the opposite edge by the clamps of an additional, synchronously driven conveyor and are transported further while suspended from the clamps.

The invention furthermore relates to an arrangement to turn over print products, transported in a conveyed flow along a conveying path while gripped and suspended, along one edge by the clamps of a circulating transporter or conveyor, the arrangement comprising a first conveyor having successively spaced apart clamps attached to a traction device that is guided around a reversing wheel. The clamps transfer the print products to the clamps of a following, synchronously driven conveyor. The arrangement furthermore comprises a turning section that operatively connects the conveyor and the additional conveyor. In addition to the conveyors, the print products are turned over with the aid of a transfer device and are transferred to the clamps of the additional conveyor with the opposite-arranged edge pointing forward.

In contrast, European patent document EP 1 547 950 A1 discloses a method and an arrangement for stabilizing and positioning flat objects, in particular print products, for which the print products, supplied while suspended from one edge so as to be suspended, are stabilized at the exposed, opposite-arranged edge, are turned over and are then transferred to the clamps of a different conveyor.

SUMMARY

It is therefore an object of the present invention to specify a method and an arrangement which permit the transfer of print products, suspended from the clamps of one conveyor, to a different conveyor once they have been turned over.

According to one aspect of the invention, there is provided a method to turn print products, which in one embodiment includes conveying the print products in a conveyed flow along a conveying path of a circulating first conveyor while holding the respective print products suspended from a first edge region by respective first closeable clamps of the circulating first conveyor; turning the print products upside down around an axis transverse to the conveying direction in a curved turning section of the conveying path adjoining an end of the first conveyor, wherein the turning includes entering the conveyed flow with a transfer device that accompanies the print products and changes the position of the print products upside down, and gripping along an opposite-arranged second edge region of the respective print products by respective second closeable clamps of a synchronously driven second conveyor moving approximately in the same direction as the transfer device; and further transporting the print products while suspended from the second edge regions by the second clamps of the second conveyor.

Thus, according to the invention, the print products are turned over before they reach the end of the conveying section of the first conveyor, on a side at which the print products are held along the first edge region while suspended, by using a transfer device which respectively accompanies the print products and is inserted for the position change along the front and back while the print products move along an adjoining, circular turning section of the conveying path. Upon leaving the turning section, the print products are transferred with the edge opposite the gripped first edge region pointing forward to a second closable clamp of the additional second conveyor driven with approximately the same timing and speed, wherein the print product is held while suspended from this second clamp.

According to another aspect of the invention, there is provided an arrangement to turn print products transported in a conveyed flow along a conveying path in a conveying direction, which in another embodiment includes a first conveyor including a reversing wheel, a traction device guided over the reversing wheel and first clamps attached to the traction device to clamp the respective print products along a first edge region to suspend the print products and the first clamps being used to transfer the print products; a second conveyor arranged downstream and offset from the first conveyor and synchronously driven with the first conveyor, the second conveyor including second clamps arranged to receive an opposite-arranged second edge region of the respective print products from the first conveyor and arranged to suspend the respective print products; and a curved turning section to operatively connect the first conveyor with the second conveyor along which the print products are turned upside down, the turning section including: a transfer device to assist in transferring the respective print products from the first conveyor to the second conveyor and to turn the print products in the turning section prior to being clamped by the second clamps, the transfer device including uniformly spaced apart, circulating controlled transfer tongs insertable into the conveyed flow of the print products conveyed through the turning section to grip the respective print products with friction or force from each side of the respective print products in order to turn the respective print products around an axis transverse to the conveying direction.

Thus, an arrangement of the aforementioned type is distinguished by a transfer device that is provided along a transfer section, extending between the end of the conveying region for the first conveyor and the start of the conveying region of the additional second conveyor. The transfer device includes uniformly spaced-apart, controlled transfer elements that circulate along an approximately circular turning section. The transfer elements enter the conveyed flow from the side where the print products are held while suspended from the first edge region by the first clamps of the first conveyor, such that they accompany the print products along the turning section, wherein the print products are transferred to the second clamps of the additional second conveyor following the turning operation.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
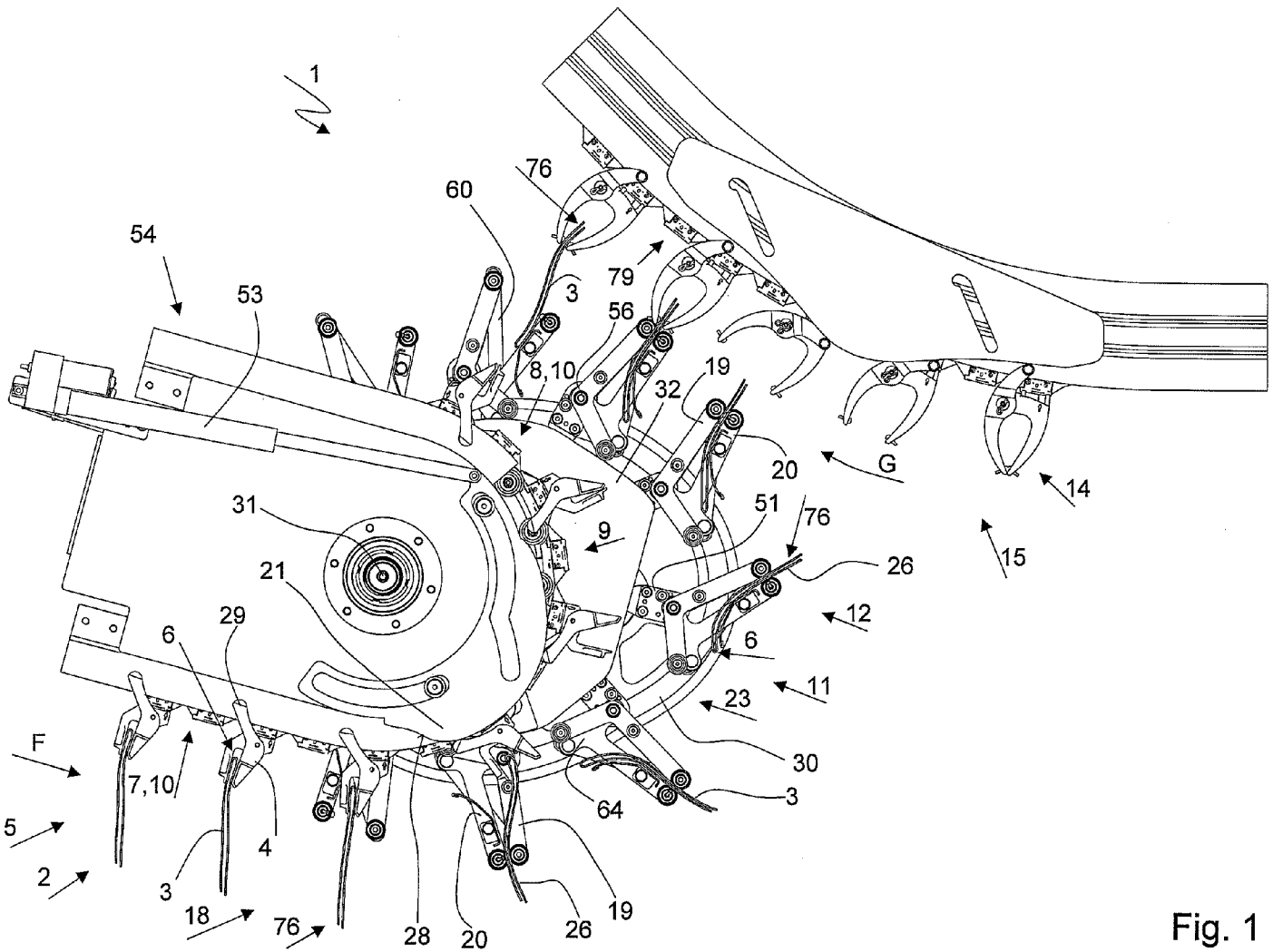
FIG. 1 is a view from the side of the device according to the invention.
Figure 2:
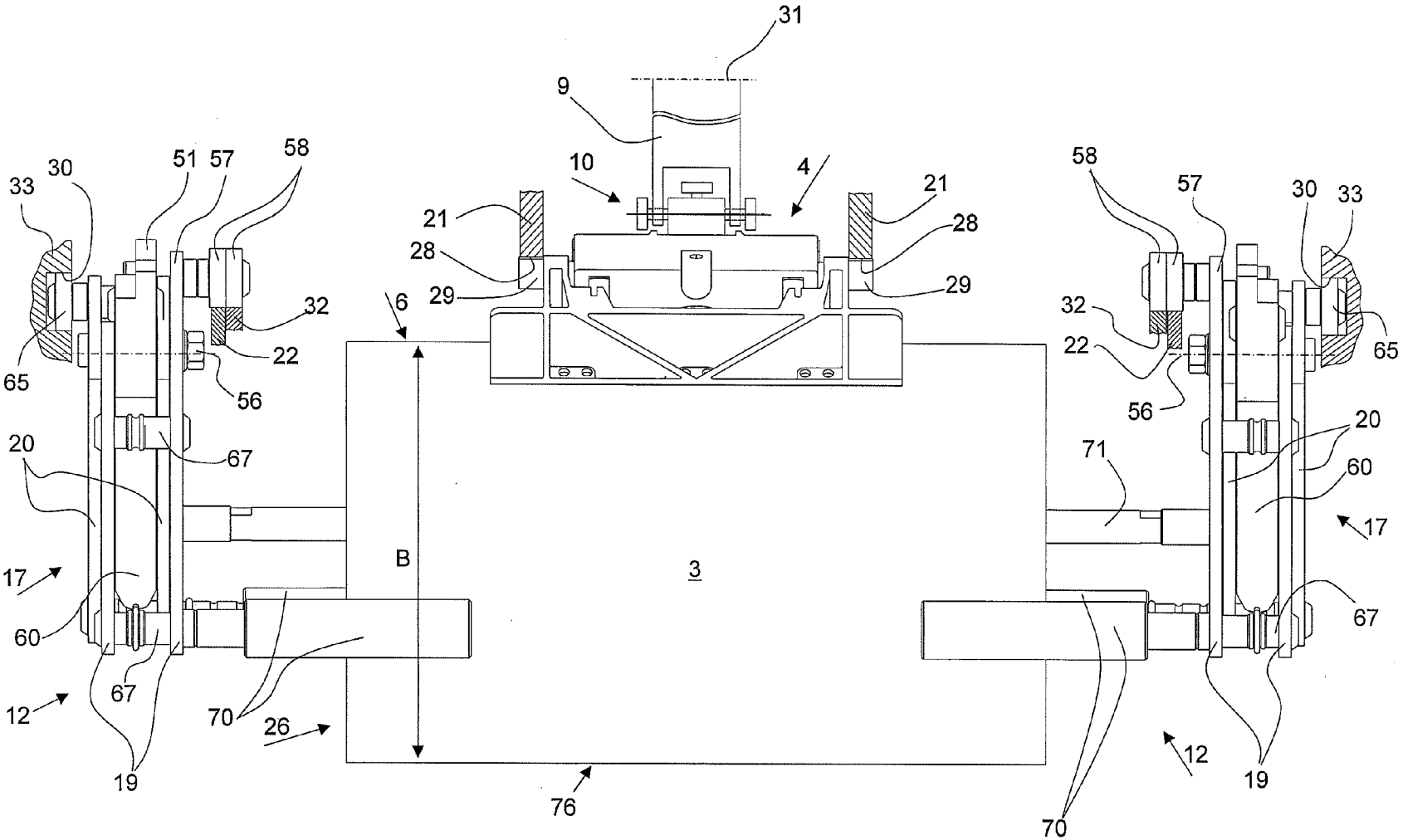
FIG. 2 is a partial end view in partial cross-sectional view through the device according to FIG. 1, showing the region where the print products are rotated.
Figure 3:
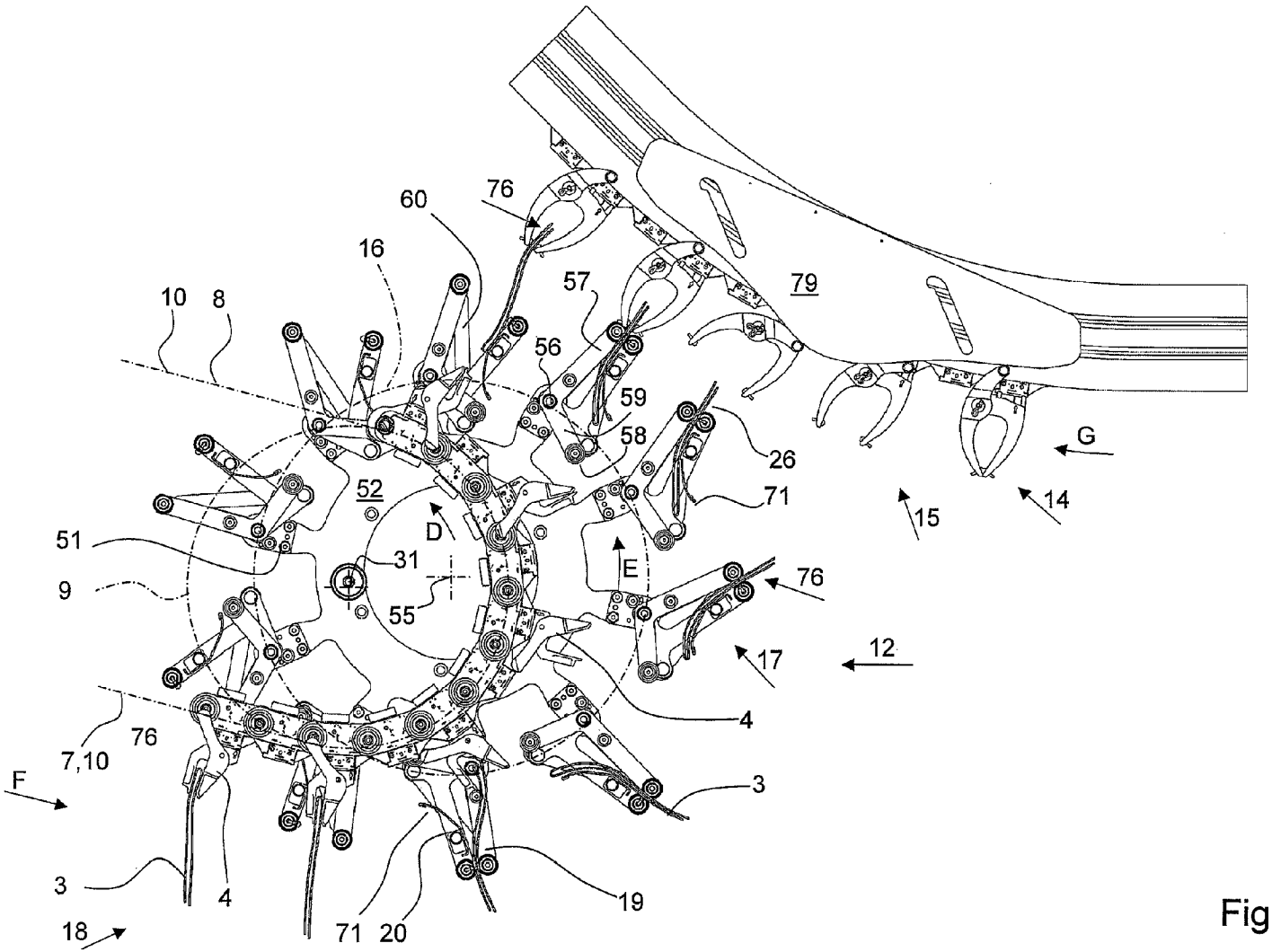
FIG. 3 is a side view showing the first conveyor operating jointly with the transfer device.

Referring to FIGS. 1 to 3, there is shown a device 1 to turn over print products 3 which are conveyed in a flow along a conveying path 2. The print products 3 are transported while clamped in along a first edge region 6 by the first clamps 4 of a circulating first conveyor 5, in order to suspend the print products. The first conveyor 5 may comprise a transporter including a working strand 7 and a slack strand 8 which jointly form a traction device 10 and are separated by a reversing wheel 9 (see FIG. 2), wherein the working strand 7 moves below the slack strand 8. The working strand 7 of the first conveyor extends along a below-arranged circumferential section of the reversing wheel 9 and ends (see FIG. 1) once the transported print product 3 is released by the first clamp 4. The first clamp 4 may be opened by a controllable cam 28 of a first control device 21.

With increasing radial distance to the circumference of the reversing wheel 9, a turning section 11 starts in which the print product 3 is turned upside down in a transfer device 12 and is supplied with a second edge 76, arranged opposite the previously clamped-in first edge region 6, to an opened second clamp 14 of a different second conveyor 15. The second conveyor 15 extends approximately tangential to an above-arranged section of a circular track 16 of the transfer device 12 and operates in the direction G which is approximately in the turning direction D of the reversing wheel 9, which is approximately counter to the direction F for feeding the print product 3 to the reversing wheel 9. The slack strand 8 of the first conveyor 5 also moves approximately in the same direction as the direction G of the second conveyor 15. For the further transport, the print products 3 are clamped into the second clamps 14 of the additional second conveyor 15 to be held while suspended.

Along the conveying path 2, just prior to reaching the reversing wheel 9, transfer tongs 17 are inserted from both sides into the flow of supplied print products while facing the front and back side of a print product 3. These tongs form the transfer device 12 and circulate uniformly spaced apart along a circular track 16, as shown in FIG. 3. The transfer tongs 17 which respectively comprise two tong parts 19, 20 can be activated and moved to an open position. In the open position, a first tong part 19 moves ahead of a print product 3, as seen in conveying direction F, while a second part 20 moves behind the print product 3. In other words, a left and a right transfer tong 17, as seen in conveying direction, is respectively assigned to each print product 3 transported in the first conveyor 5. The transfer tong 17 is assigned to the print products 3 before they are released from the first clamp 4 of the first conveyor 5. The transfer tongs 17 transfer the print product to the second clamps 14 of the additional second conveyor 15.

Along the conveying path 2 for the print products 3, the transfer device 12 forms the turning section 11 and extends from the conveying region end of the first conveyor 5 to the transfer location for the transfer to the additional second conveyor 15. In this section, the print products 3 are conveyed suspended in the first conveyor 5. The print products 3 are gripped with friction or force by the transfer tongs 17 and are then turned and transferred by the tongs to the second clamps 14. During the insertion of the transfer tongs 17 into the conveyed flow 18, the transfer tongs 17 are moved with a control arrangement 23, positioned along the conveying path 2. The transfer tongs 17 are moved from the open position to a close position (successively). The clamps 4 of the first conveyor 5 open while the transfer tongs 17 close (see FIG. 1).

A control arrangement 23 is provided for the opening and closing of the transfer tongs. The control arrangement 23 comprises a first control device 21 for opening the clamps 4 of the first conveyor 5 and second and third control devices 22, 32, assigned to the transfer device 12, to close and open the transfer tongs 17. The movement for closing the transfer tongs 17 takes place first along the third control device 32 and subsequently along the adjustable second control device 22. Along the continued conveying path 2 and the turning section 11, the print products 3 held by the transfer tongs 17 are turned further with the aid of a control device 33 and are moved toward a second clamp 14 assigned to the transfer tong 17.

The overhanging portion 26 of the print product 3, which results from the joint operation between the clamp 4 of the first conveyor 5 and an associated transfer tong 17, is used as a gripping second edge region for the transfer of the print products 3 into the clamps 14 of the additional second conveyor 15. The overhanging portion 26 respectively corresponds to the opposite-arranged second side edge where the clamps 14 grip the print products 3 after they are turned.

The first control device 21, arranged along the conveying path 2, respectively at the start of the turning section 11, opens the clamps 4 of the first conveyor 5 during the transfer of the print products 3 to the transfer tongs 17. The first control device 21 comprises a first control cam 28, along which a control lever 29 of the first clamp 4 extends. The opening of the clamps 4 occurs simultaneously with the closing of the transfer tongs 17 in the turning section 11. The closed transfer tongs 17 are aligned with the aid of a control cam 30 (FIGS. 1 and 2) to transfer the print products 3 to the second clamps 14.

To be able to process differently sized print product formats, the first and second control devices 21, 22 are adjustable, and the circular track 16 for the transfer tongs 17 is arranged offset to the reversing wheel 9 of the first conveyor 5. For small print product formats, the first and second control devices 21, 22 are adjusted so that the transfer of the print products 3 from the clamp 4 to the transfer tong 17 occurs shortly after the transfer tong 17 is inserted into the conveyed flow 18.

With larger print product formats, the first and second control devices 21, 22 are adjusted so that the clamps 4 open up later and the transfer tongs 17 close later. The transfer of the print products 3 from the first clamp 4 to the transfer tong 17 thus occurs in a downstream direction toward the turning section 11. This helps to ensure that print products 3 with different formats have the desired overhang 26 in the turning section 11 for the further transfer to the second clamps 14.

The mode of operation of the device 1 and the respective features and their arrangement are described in the following with the aid of the drawings, insofar as these are not obvious from the Figures.

FIG. 1 sequentially shows the operational steps of conveying the print products 3, supplied suspended while clamped in along the upper edge region 6 by a closed first clamp 4 of a first conveyor 5, for example a transporter. In the reversing region of the horizontal axis of rotation 31, or at the conveying end of the transporter 5, the print products 3 are transferred from the open first clamps 4 with the aid of a control lever 29 along the first control device 21 to a transfer device 12. The transfer device 12 then transports the print products 3 taken over from the transfer tongs 17 to the additional second conveyor 15.

Following the takeover of the print products 3 by the transfer device 12, the clamps 4 jointly move away from the conveying path 2 for the print products 3 and the first control device 21, in the direction of the non-depicted feeding station. During this operation, the print products 3, clamped in at the first edge region 6 by the first clamps 4, are turned via the transfer device 12 from the suspended position, with the second oppositely-arranged edge region 76 exposed. The print products 3 are thus transferred to the second clamps 14 of the additional second conveyor 15 and gripped by the second clamps 14 by the second edge region 76. Along the way, the closed transfer tongs 17 are pivoted on holders 51 of a rotating hub 52 from a takeover position to a transfer position for supplying the print products 3 to the second clamps 14 of the additional second conveyor 15 (see also FIGS. 1, 3, 4, 6).

Figure 7:
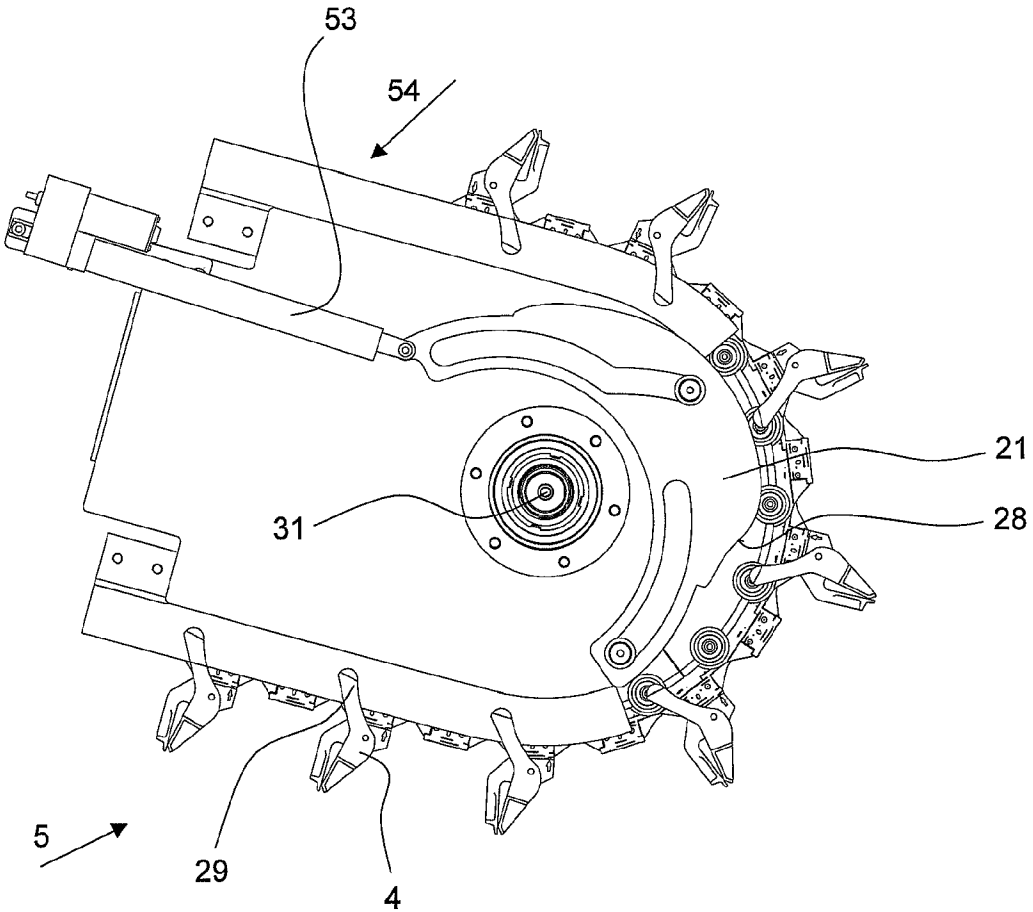
FIG. 7 is a side view of a switching device for stopping the operation of the opening mechanism for the clamps of the feeding device.

The opening of the first clamps 4 for the transfer of the print products 3 to the transfer device 12 can be prevented by pivoting away the first control device 21 with the aid of a pneumatically or electrically operated activation element 53 of a switching device 54, as shown with the details in FIG. 7. If the goal is to keep the print products 3 in the clamps 4, they will be transported further by the first conveyor 5. For this purpose, the rotors 66 can be moved axially toward the outside, so that the transfer tongs 17 no longer enter the conveying flow 18.

The previously addressed transfer device 12, illustrated in FIGS. 1 to 6, includes transfer tongs 17 that can be opened and closed and are arranged along the periphery of the rotor 66, rotating around an axis 55, which is formed with two hubs 52. In the transfer region, the transfer tongs grip the print products 3 on the feeding device 5 with the aid of a friction or force and pivot them into a position for the transfer to the additional second conveyor 15. The transfer tongs 17 essentially comprise two lever-type tong parts 19, 20. The part 19 moves ahead and a trailing part 20 can be pivoted around a horizontal pivoting axis 56 on the holder 51 that is attached to the hub 52.

For controlling the transfer tongs 17, the tong parts 19, 20 comprise dual levers with angled lever arms. The leading tong part 19 is composed of a lever arm 57 that projects toward the outside, relative to the axis of rotation 55, and a guide arm 59 that is fixedly connected to the lever arm at the pivoting axis 56. The leading tong part 19 is provided at the exposed end with two trailing, freely rotating rolls 58, wherein this guide arm determines the position of the lever arm 57 for the closing and the opening of a transfer tong 17.

The closing of the transfer tongs 17 is achieved with the aid of a tension spring 60 that connects the tong parts 19, 20. The stationary control device 32, formed by an open control track 61 that extends over the opening region of the transfer tongs 17, is responsible for the open position of the leading tong part 19. The opening of the transfer tongs 17 occurs at the instant when the print products 3 have been gripped by the second clamps 14 of the additional second conveyor 15, until the location is again reached where print products 3 are taken over by the first clamps 4 of the first feeding device 5 (FIGS. 1, 3, 4, 6).

Figure 4:
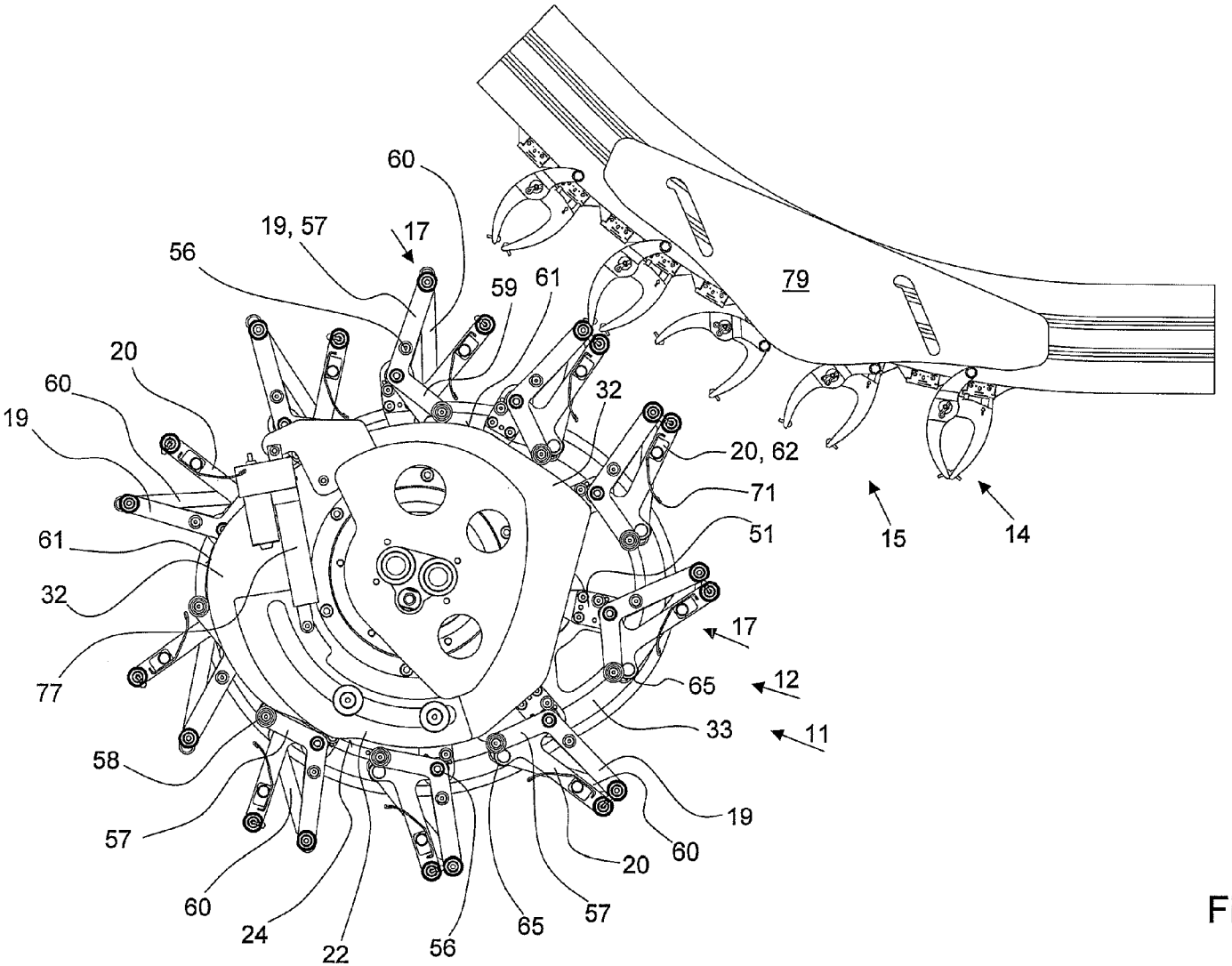
FIG. 4 is a side view of the transfer device and the associated control devices.

Similar to the tong part 19, the trailing tong part 20 comprises a double lever with angled lever arms 62, 63. The lever arm 62 projects toward the outside and, in the connecting region is attached to the pivoting axis 56, together with the other lever arm 63 that is arranged at an acute angle. A guide arm 64 of the tong part 20, which extends counter to the rotational direction E, is provided at the exposed end with a roll 65 that runs inside a form-fitting control cam 30. This connection is illustrated in FIGS. 1 and 4 with a sequential representation of the position for the transfer tongs 17 along the conveying path 2 for the print products 3, starting with the feeding by the conveyor 5 to the transfer to the additional second conveyor 15. The tension spring 60 functions to keep the transfer tongs 17 closed, whereas the opening of the tongs 17 is achieved with the second and third control devices 22 and 32.

Figure 5:
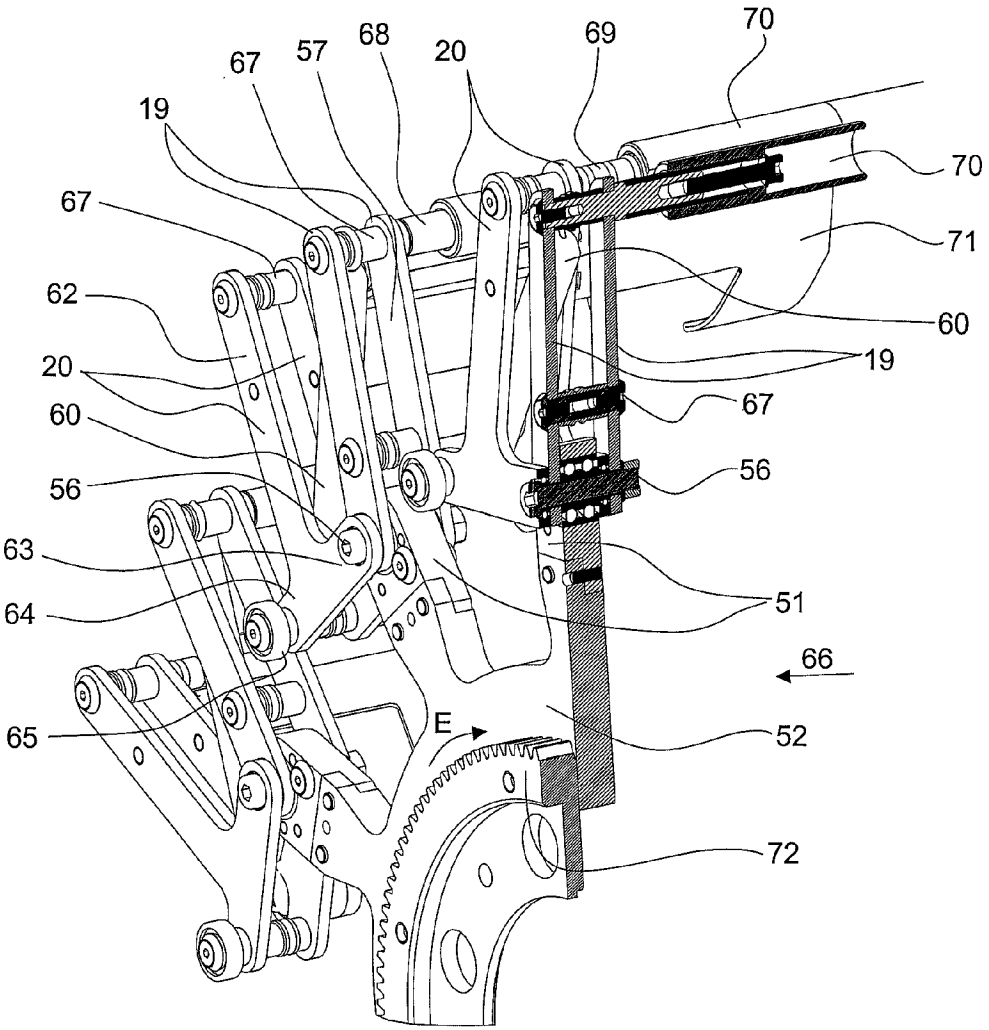
FIG. 5 is a perspective view in partial sections showing details of the transfer device.

FIG. 5 shows the individual components of the transfer tongs 17, as well as the arrangement on the rotor 66 for the transfer device 12 which is formed by two adjacent hubs 52, with the holders 51 attached uniformly spaced apart along the periphery. The tong parts 19, 20 are respectively embodied with twice the number of individual components for the purpose of reinforcement, which assists in a more stable arrangement. The individual components are spaced apart on the side with the aid of spacers 67. The spacers 67 are extended at the exposed ends of the tong parts 19, 20 by a shaft 68, 69 to which holding elements 70 are attached, such that they can rotate freely. The holding elements 70 are embodied as cylindrical sleeves with a frictional surface between which the print products 3 can be clamped in on both sides, relative to the movement direction.

Figure 6:
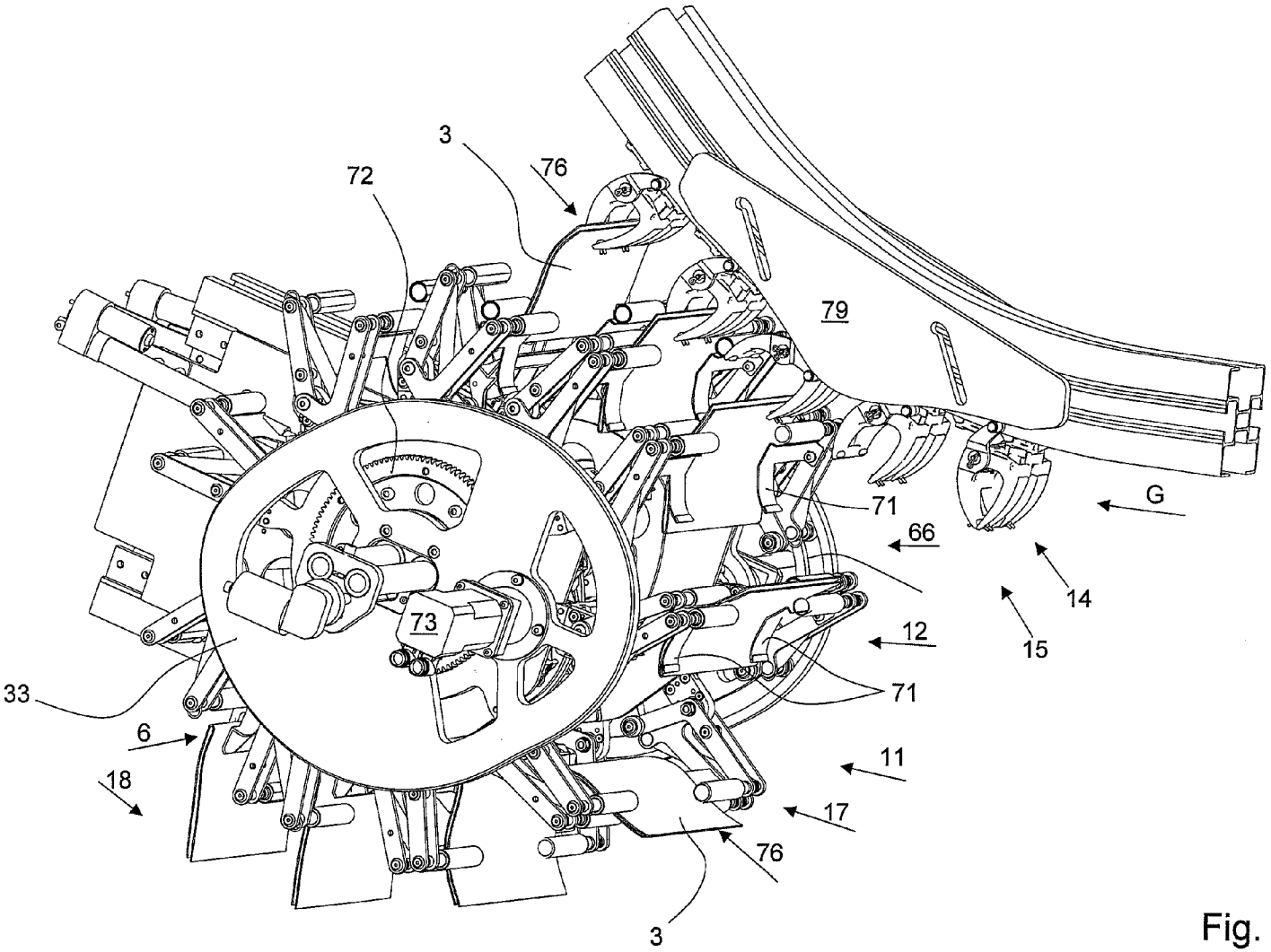
FIG. 6 is a perspective view of the transfer device jointly operating with the additional conveyor.

FIG. 6 illustrates the transfer device 12, showing the print products 3 clamped in between the holding elements 70 of the transfer tongs 17. In addition, FIG. 6 shows how the print products are turned upside down once they are gripped by the tongs 17 and are inserted into the second clamps 14 of the additional second conveyor 15. FIG. 6 is a perspective view of the transfer device 12 and the dual embodiment of the transfer tongs 17 for holding the print products 3 from both sides, wherein the holding elements 70 of the tongs are arranged on opposite sides and face in opposite directions. This results in a stabilization of the print product 3 which is further aided by the support elements 71 that are attached to the trailing tong parts 20.

A toothed wheel or cog wheel 72 to which the hub 52 of the rotor 66 is attached on one side and which is drive-connected to a motor 73 that is attached to the back of the control arrangement 23 is shown in FIGS. 5 and 6.

FIG. 4 furthermore illustrates that the closing movement of the transfer tongs 17 during the takeover of the print products 3 from the first conveyor 5 can be adjusted in that an adjustable second control device 22 for adjusting the cam 61 along the control path 2 is connected to the third control device 32. The second control device 22 comprises a control cam 24 which is embodied to close the transfer tongs 17 when taking over the print products 3. The second control device 22 is connected to a switching device 77 that is arranged on the third control device 32. An electrically or pneumatically operated element 78 moves the second control device 22 to the desired position, to that the closing of the transfer tongs 17 is coordinated with the opening of the first clamps 4.

It will be understood that the above description of the present invention is susceptible to various modifications, changes and adaptations, and the same are intended to be comprehended within the meaning and range of equivalents of the appended claims.

What is claimed is:

1. A method to turn print products, comprising:

conveying the print products in a conveyed flow along a conveying path of a circulating first conveyor while holding the respective print products suspended from a first edge region by respective first closeable clamps of the circulating first conveyor;

turning the print products upside down around an axis transverse to the conveying direction in a curved turning section of the conveying path adjoining an end of the first conveyor, wherein the turning includes entering the conveyed flow with a transfer device that accompanies the print products and changes the position of the print products upside down, and gripping along an opposite-arranged second edge region of the respective print products by respective second closeable clamps of a synchronously driven second conveyor moving in the same direction and at the same speed as the first conveyor; and further transporting the print products while suspended from the second edge regions by the second clamps of the second conveyor.

2. The method according to claim 1, further comprising inserting the respective print product into the respective second clamp before an end of the turning section.

3. The method according to claim 1, wherein:

the conveying includes circulating the transfer device continuously along an endless or circular track; and wherein the transfer device includes uniformly spaced-apart transfer tongs, and the turning includes controlling the respective transfer tongs to move to a close position to positively grip the print product by friction or force and to move to an open position in an end region of the turning section.

4. The method according to claim 3, wherein the turning includes assigning the respective transfer tong of the transfer device to a respective one of the print products at least along the turning section.

5. The method according to claim 3, wherein the entering includes inserting the transfer tongs of the transfer device into one side of the conveyed flow and the method further includes guiding the transfer tongs out of the conveyed flow from the same one side.

6. The method according to claim 3, wherein the turning further comprises moving the transfer tongs of the transfer device from an open position to a close position in the turning section at the same time the first clamps respectively open to release the respective print product.

7. The method according to claim 6, wherein the turning further comprises projecting an overhang section of the respective print products from the respective transfer tongs in dependence of the release of the respective print product from the respective first clamp and the close of the respective transfer tong.

8. The method according to claim 3, wherein the turning includes:

closing the transfer tongs of the transfer device along the conveying path while moving through a below-arranged region of the turning section; and opening the transfer tongs while moving through an above-arranged region of the turning section.

9. The method according to claim 3, wherein the turning includes:

controlling the orientation of the print products in the turning section with respect to a position change for a take-over of the print product by the respective transfer tongs of the turning device and for a transfer of the print product to the respective second clamps.

10. The method according to claim 1, wherein the conveying end of the first conveyor is formed by a reversing wheel of a traction device that includes the first clamps, and the method further includes providing the curved turning section to extend outside and offset to the reversing wheel.

11. An arrangement to turn print products transported in a conveyed flow along a conveying path in a conveying direction, the arrangement comprising:

a first conveyor including a reversing wheel, a traction device guided over the reversing wheel and first clamps attached to the traction device to clamp the respective print products along a first edge region to suspend the print products and the first clamps being used to transfer the print products;

a second conveyor arranged downstream and offset from the first conveyor and synchronously driven with the first conveyor, the second conveyor including second clamps arranged to receive an opposite-arranged second edge region of the respective print products from the first conveyor and arranged to suspend the respective print products; and a curved turning section to operatively connect the first conveyor with the second conveyor along which the print products are turned upside down, the turning section including:

a transfer device to assist in transferring the respective print products from the first conveyor to the second conveyor and to turn the print products in the turning section prior to being clamped by the second clamps, the transfer device including uniformly spaced apart, circulating controlled transfer tongs insertable into the conveyed flow of the print products conveyed through the turning section to grip the respective print products with friction or force from each side of the respective print products in order to turn the respective print products around an axis transverse to the conveying direction.

12. The arrangement according to claim 11, wherein the transfer tongs face the first clamps and circulate along an endless track, the transfer tongs including a first tong part and a second tong part controllable to move from an open position to a close position to grip the print product with friction or force in the turning section as the first clamp opens, wherein the transfer tongs hold and turn the respective print products to transfer the print products to the second clamps, respectively, of the second conveyor that extends above the turning section, approximately tangential thereto.

13. The arrangement according to claim 12, wherein the first and second tong parts of the transfer tongs are respectively insertable at a front and back side of the respective print products, and the arrangement further includes a control arrangement to open and close the first and second tong parts, to orient the print products in the turning section and to open and close the first clamps and the second clamps.

14. The arrangement according to claim 13, wherein the control arrangement includes a first control device to open the first clamp, and a second and a third control device to open and close the transfer tongs.

15. The arrangement according to claim 14, wherein the first, second, and third control devices comprise at least one of a control cam or control track engageable with the first clamps and the transfer tongs.

16. The arrangement according to claim 14, wherein the first and second control devices are adjustable.

17. The arrangement according to claim 12, wherein the endless track is arranged offset to an axis of the reversing wheel.

18. The arrangement according to claim 11, wherein the first conveyor includes a lower strand, functioning as a working strand and driven in an opposite direction relative to a conveying direction of the second conveyor.

19. The arrangement according to claim 11, further comprising a closing device to act upon the second clamps and arranged in an area where the transfer tongs approach the second conveyor.

* * * * *